United States Patent [19]

Uithoven

[11] Patent Number: 4,821,638

[45] Date of Patent: Apr. 18, 1989

[54] APPARATUS FOR SUPPORTING AND PRINTING CYLINDRICAL OBJECTS

[75] Inventor: Pieter G. Uithoven, Gorssel, Netherlands

[73] Assignee: Thomassen & Drijver-Verblifa NV, Netherlands

[21] Appl. No.: 70,246

[22] Filed: Jul. 6, 1987

[30] Foreign Application Priority Data

Jul. 4, 1986 [NL] Netherlands ..... 8601754

[51] Int. Cl.[4] ..... B41F 17/22

[52] U.S. Cl. ..... 101/40

[58] Field of Search ..... 101/40, 39, 38 A, 38 R

[56] References Cited

U.S. PATENT DOCUMENTS

| | | | |
|---|---|---|---|
| 3,548,745 | 12/1970 | Sirvet et al. | 101/40 |
| 3,563,170 | 2/1971 | Cvacho et al. | 101/40 |
| 3,695,176 | 10/1972 | Van der Roer | 101/39 |
| 3,851,579 | 12/1974 | Zurick | 101/39 |
| 3,996,851 | 12/1976 | Urban | 101/40 |
| 4,018,151 | 4/1977 | Urban et al. | 101/40 |
| 4,037,530 | 7/1977 | Sirret | 101/40 |
| 4,140,053 | 2/1979 | Skrypek et al. | 101/40 |
| 4,404,900 | 9/1983 | Ozawa et al. | 101/40 |
| 4,498,387 | 2/1985 | Stirbis | 101/40 |

*Primary Examiner*—Clifford D. Crowder
*Attorney, Agent, or Firm*—John P. Snyder

[57] ABSTRACT

An apparatus for successive printing of cylindrical objects includes a driven carrying wheel; a number of spindles on the wheel freely rotatable about their longitudinal axes parallel to the axis of rotation of the carrying wheel; a printing station radially adjacent the path of the spindles for successively printing the objects; and structure for detecting possible absence of an object and connected to control and deflection structure for temporary deflection of the spindle path out of printing contact. Each spindle is carried by a carriage which can move radially of the carrying wheel and which is guided by a first guide member and a second guide member which cooperates with a guide groove for determining the path of the spindle carried by the carriage. Each spindle is carried such that the pressure force applied thereto during printing of an object can substantially be absorbed without moment by both guide members. The deflection structure is formed such that a deflection-guide groove part at the printing stations can move between an active printing position and an inactive deflecting position with the printing position being stable in relation to the pressure force applied.

19 Claims, 7 Drawing Sheets

APPARATUS FOR SUPPORTING AND PRINTING CYLINDRICAL OBJECTS

The invention relates to an apparatus for successive printing of the peripheral surfaces of cylindrical objects open at one end, for example metal beakers or cans, which apparatus comprises: a carrying wheel which can be driven for rotation at a pre-selected rotation speed; a number of spindles arranged on the periphery of that carrying wheel and freely rotating around their longitudinal axis parallel to the axis of rotation of the carrying wheel for carrying the objects, which spindles have a form such that the objects to be printed fit onto them precisely; a printing station placed in radial direction alongside the path of the spindles for successive printing of the objects carried by the spindles; detection means for detecting the possible absence on a spindle of an object for printing, which detection means are connected to control means; and deflection means controlled by these control means for temporary deflection of the path of such a spindle such that it is held out of contact with the printing station.

Such an apparatus is known from U.S. Pat. No. 4,018,151. Also known is an apparatus whereby the spindles are carried via complicated arm constructions such that said constructions can tend to bend during the printing process, as a result of which sufficient pressure cannot be developed at all positions. It is therefore necessary with such a known apparatus to take steps to compensate to some extent for the bending of the spindle.

The construction of the apparatus as according to U.S. Pat. No. 4,018,151 is such that a pneumatic cylinder co-operates directly in radial direction with a deflection-guide groove part. This implies that the force for printing has to be produced by the force applied by the pneumatic cylinder. This force can vary as a consequence of age, wear or other causes, which is undesirable.

The invention has for its object to obviate the deficiences and limitations of the current state of the art and in this respect provides an apparatus of the type referred to which has the feature that each spindle is carried by a carriage which can move in radial direction relative to the carrying wheel and which is guided by a first guide member, on which carriage is also arranged a second guide member which co-operates with a guide groove for determining the path of the spindle carried by the carriage; that each spindle is carried such that the pressure force applied thereto during printing of an object can substantially be absorbed without moment by both guide members; and that the deflection means are formed such that a deflection-guide groove part at the location of the printing station can move between two extreme positions, respectively an active printing position and an inactive deflecting position, and that the printing position is one that is stable in relation to the pressure force applied.

In order to make the amount of energy necessary for the control of the deflection-guide groove part as small as possible and to effect as fast a switching between both positions as possible,the embodiment is recommended in which the deflection-guide groove part is present in a pivoting member.

With a variant which has the feature that the foremost end of the deflection-guide groove part connects in both positions with the relevant end of the guide groove, is achieved that the in-feed of a second following guide member can always take place irrespective of the position of the deflection-guide groove part and its total length relative to the distance apart of two successive second guide members.

A great density of the spindles, that is, a large number of spindles on the periphery of the carrying wheel, can be obtained in an embodiment characterized by two guide grooves located radially at a distance from each other for guiding the second guide members of successive carriages.

To effect the printing as accurately as possible the variant is recommended which is characterized by rotation means positioned upstream of the printing station for bringing the objects carried by the spindles up to the rotation speed necessary for printing. In this embodiment the heavy and therefore slow spindles are set for a period of time in an accelerated rotation so that no further acceleration is needed during printing. This is beneficial to the precision of the printing process.

Use can be made in particular of an embodiment in which the rotation means are formed as a flexible belt or rope which presses against the object carried by the spindles, which extends alongside the path of the object for some tangential distance and which can be riven at a speed corresponding to the required rotation speed.

In order to prepare the objects easily for a following treatment step after the printing process, use can be made of an embodiment which is characterized by braking means placed downstream of the printing station for decelerating the rotation of the spindles.

In order to ensure a very simple and reliable positioning of the objects on the spindles an apparatus according to the invention can be characterized by an opening on the free end face of each spindle to be temporarily connected at a required moment in time with a source of underpressure for suction holding of an object.

For easy removal of an object from a spindle the embodiment can be applied which is characterized by an opening on the free end face of each spindle to be temporarily connected at a required moment in time with a source of overpressure for removal of an object.

Both last mentioned variants can be combined in an embodiment which is provided with one opening which can be connected at choice to the source of overpressure of the source of underpressure.

In order to effect a rotation of the spindles that is as free of friction and as reliable as possible a variant can be advantageously used in which each carriage bears a fixed shaft on its free end, which fixed shaft bears a spindle via a ball bearing arranged on its free end and a needle bearing arranged on its other end. The ball bearing is used for the axial positioning of the pressure spindle, while the needle bearing functions as support bearing.

A further variant displays the feature that each second guide member comprises two rollers, one for co-operation with the inward lying guide groove wall, and one for co-operation with the outward lying guide groove wall. With this embodiment is achieved that both rollers are at all times required to roll in only one direction, which avoids a roller having to change direction regularly.

With a particular view to a very rigid but nevertheless very simple construction, in a preferred embodiment each carriage comprises: a first portion which bears the first and second guide members; a second portion extending transversely from the end lying radially outward and along the periphery of the wheel; and a third portion bearing a spindle extending parallel to the first portion from the free end of the second portion.

The apparatus according to the invention enables very reliable operation and excellent process control in the printing of objects. In this respect a preferred embodiment of the apparatus comprises spring means for pressing the second guide member counter to the centrifugal force against the inner wall of the guide groove. These spring means ensure that the process forces are completely under control during printing as a result of the spring force of the spring means acting counter to the centrifugal force. This aspect has been found to contribute to a very important extent to the complete control of the process just referred to.

With respect to the preferred embodiment just described it is noted that use can also be made in this preferred embodiment of a guide member with two rollers, one of co-operation with the inward lying guide groove wall, and one for co-operation with the outward lying guide groove wall. Although in principle only the roller which co-operates with the inward lying guide groove wall is in continual use, the other roller is of importance in absorbing small clearances, irregularities and the like, and is desirable as such in a practical embodiment.

The invention will now be elucidated with reference to the annexed drawing. In the drawing.

Figure 1:
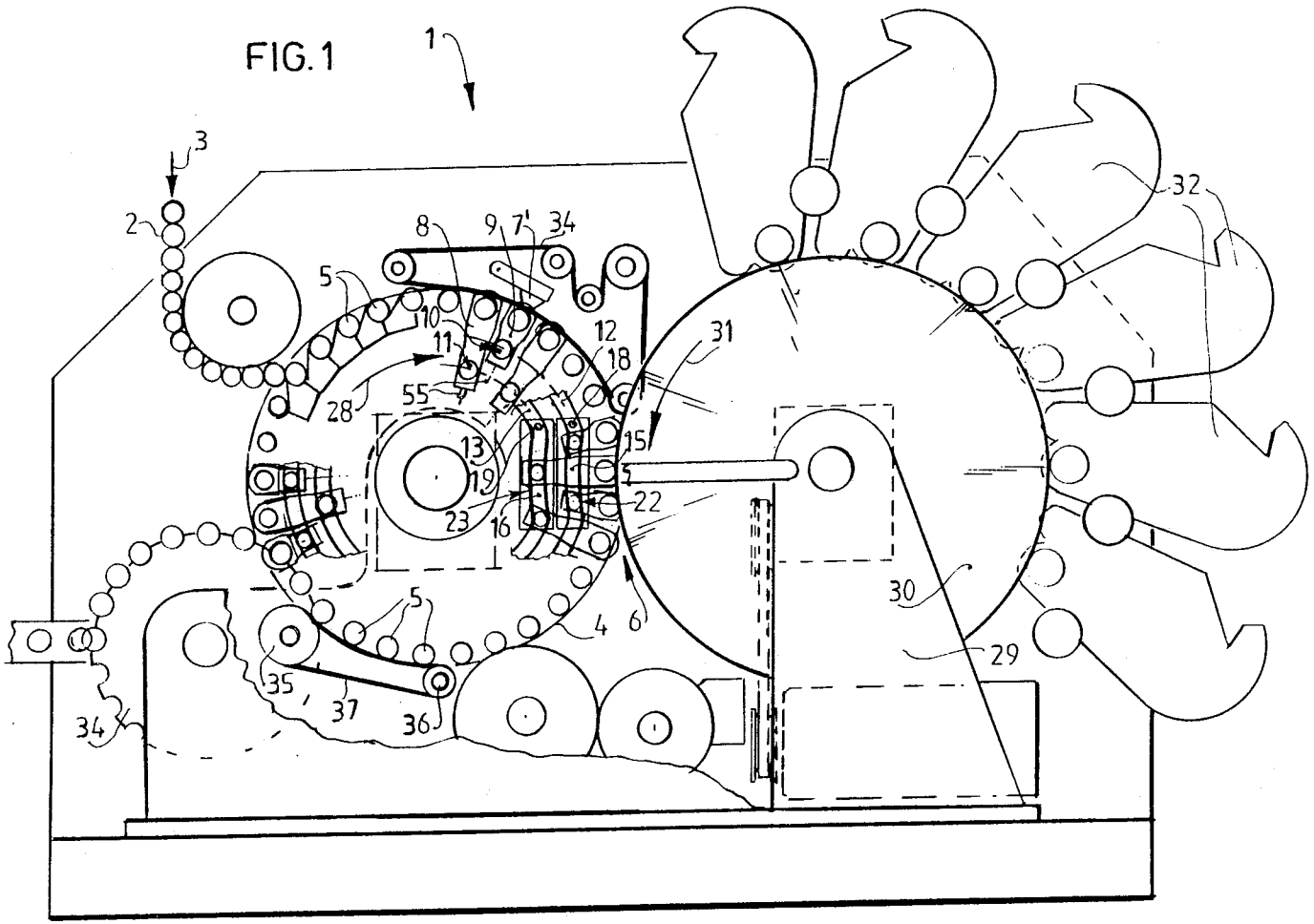
FIG. 1 shows a schematic front view of an apparatus according to the invention.

FIG. 1 shows an apparatus 1 for successive printing of the peripheral surfaces of metal cans 2, which are fed in at the inlet side indicated with an arrow 3. Apparatus 1 comprises a carrying wheel 4 which can be driven for rotation at a pre-selected rotation speed, a number of spindles 5 arranged on the periphery of that carrying wheel 4 and freely rotating around their longitudinal axis parallel to the axis of rotation of carrying wheel 4 for carrying the cans 2, which spindles 5 have a form such that the cans 2 to be printed fit onto them precisely, a printing station 6 placed in radial direction alongside the path of spindles 5 for successive printing of the cans 2 carried by spindles 5, detection means 7' for detecting the possible absence on a spindle 5 of a can for printing, which detection means are connected to control means not drawn in FIG. 1, and deflection means to be described hereinafter controlled by these control means for temporary deflection of the path of such a spindle 5 such that it is held out of contact with the printing station 6.

Each spindle 5 is carried by carriage 8, 9 which can move in radial direction relative to the carrying wheel and which is guided by a first guide member 7 (see FIGS. 2 and 3, in the form of a roller bearing), on which carriage is also arranged a second guide member 10 and 11 which co-operates with a guide groove 12 and 13 respectively for determining the path of the spindle 5 carried by the relevant carriage 8, 9. As will be further explained hereafter each spindle 5 is carried such that the pressure force, which is indicated in FIG. 3 with an arrow 14, applied thereto during printing of a can 2 can substantially be absorbed without moment by the first guide member 7 and the second guide member 10 and 11.

Figure 5:
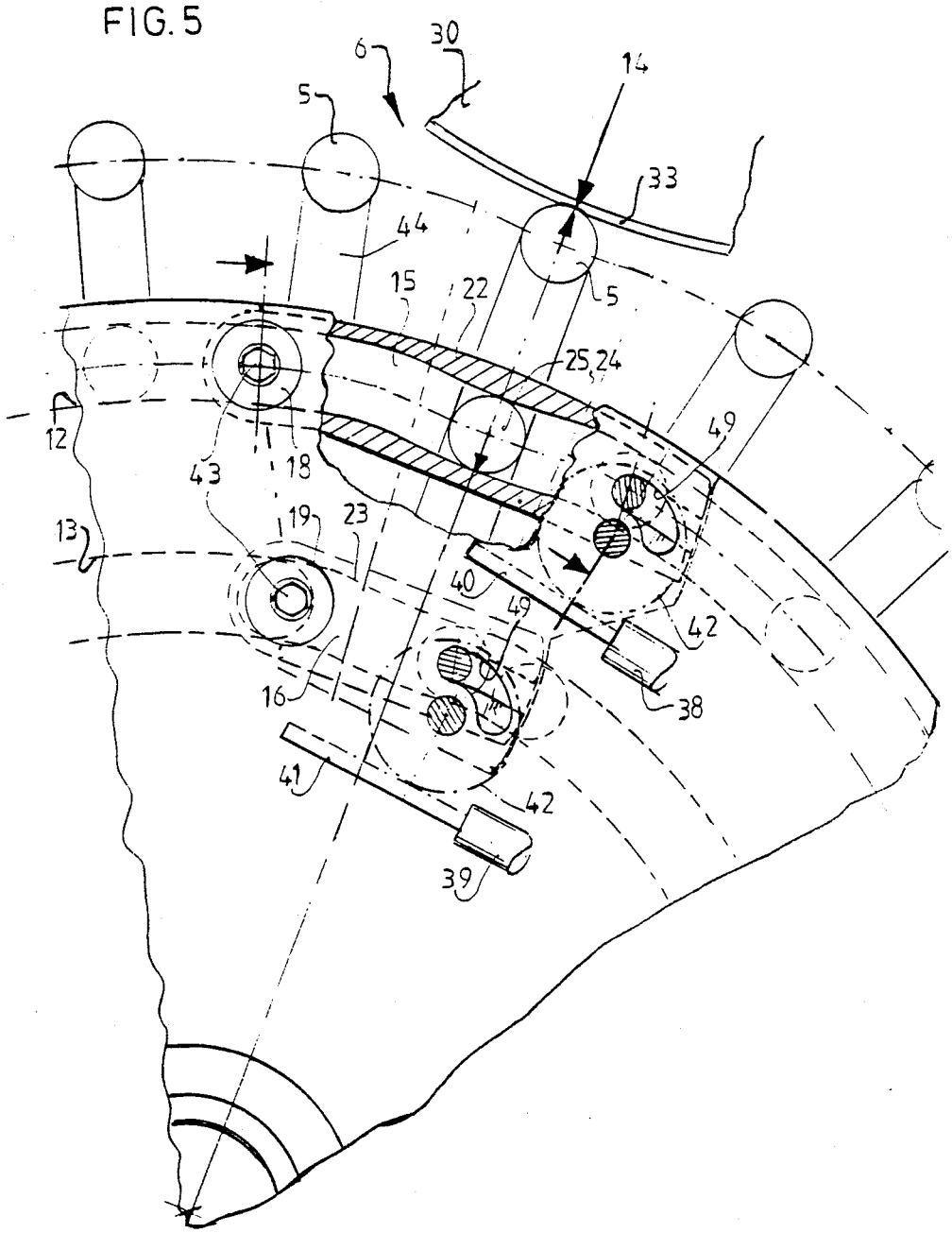
FIG. 5 shows a partly broken away front view of a detail of the apparatus in the printing position.
Figure 6:
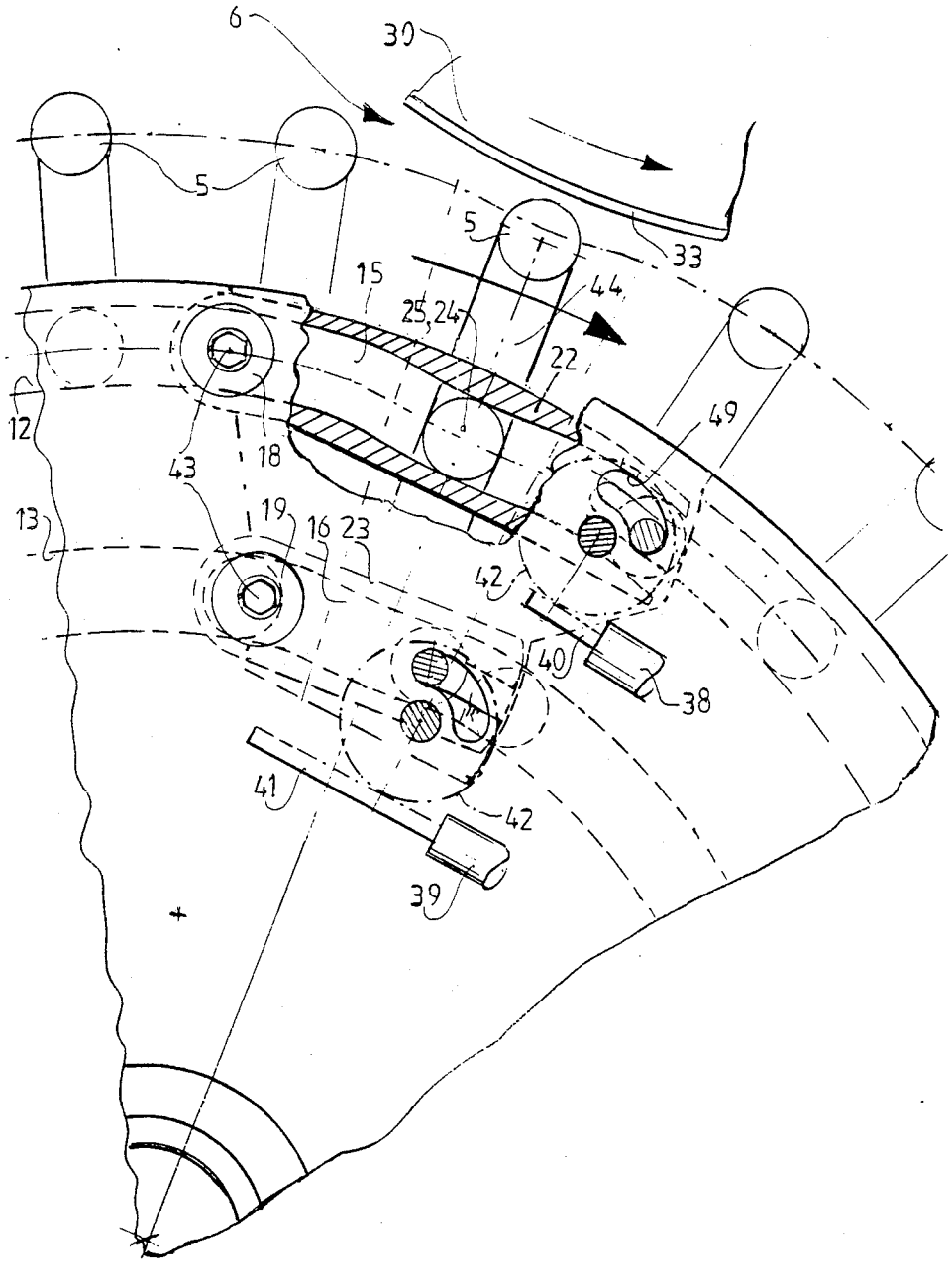
FIG. 6 is a view corresponding to FIG. 5 of the apparatus in the deflecting position.
Figure 7:
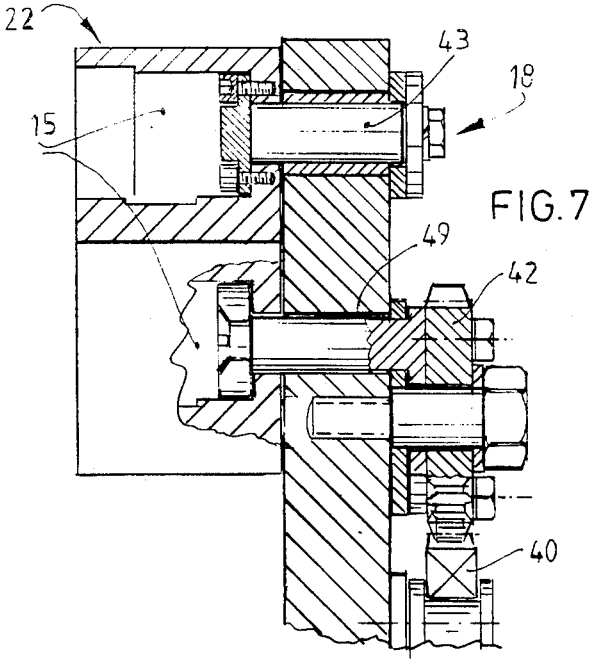
FIG. 7 is a cross section through the mechanical control apparatus for the deflecting means.

In the area of the printing station 6 the guide grooves 12, 13 comprise respective deflection-guide groove parts 15, 16 which are accommodated in pivoting blocks 22, 23 which can move between two extreme positions, respectively an active printing position and an inactive deflecting position, as will be explained later with reference to FIGS. 5 and 6 respectively, whereby the printing position is one that is stable in relation to the radial force applied.

The foremost ends, 18, 19 of the deflection -guide groove parts, 15 and 16 respectively connect in both positions with the relevant ends 20, 21 respectively of the guide grooves 12, 13.

The second guide members 10 and 11 each comprise two freely rotating rollers 24, 25 which respectively co-operate with an elevated part 26 of the outward lying guide groove wall and an elevated part 27 of the inward lying guide groove wall. It is noted that for the sake of convenience in the case of both guide grooves 12, 13 and both types of carriage 8, 9 the said elevated wall parts and the rollers forming the second guide members are designated with the same reference.

The rotation direction of the carrying wheel 4 is indicated with an arrow 28.

A printing apparatus 29, which will not be discussed in detail, comprises a rotating member 30 which has a direction of rotation indicated with an arrow 31.

Printing apparatus 29 comprises a number of print units corresponding with different colour images, which are all designated for the sake of convenience with 32. The rotating member 30 comprises, as shown schematically in FIG. 2, rubber transfer pressure pads 33 which at the location of printing station 6 are intended to transfer a colour image onto a supplied can 2. For this purpose the speeds of the outer surfaces of cans 2 and those of the rubber transfer pads 33 are the same as each other. This is achieved by rotation means placed upstream of printing station 6, which means take the form of a belt 34 which presses against the cans carried by the spindles 5, which extends for some tangential distance along the path thereof and which can be driven at a speed corresponding with the required speed of rotation.

Placed downstream of printing station 6 are braking means constructed in similar manner for decelerating the rotation of spindles, whereby the printed cans 2 can be easily removed and conveyed further by means of a star wheel 34. These braking means take the form of a flexible belt 37 guided over two rollers 35, 36.

In this embodiment the deflection-guide groove parts 15, 16 possess a form such that the respective spindles 5 are guided in a path that is concentric to the active outer surface of the rotary member 30 at the location of the printing station 6. The dimensioning is thereby such that a can 2, which is carried by a spindle 5 presses with a predetermined force against the active surface (respective rubber image transfer sheets) on the rotary member 30.

The remaining portion of the guide grooves 12, 13 takes a circular arc form, concentric to the axis of rotation of carrying wheel 4. As will be apparent, inertia resistance and the accompanying problems of wear are prevented as a result.

The apparatus according to the invention is designed such that the subjecting of a spindle 5 on which there is no can 2 to a printing treatment at the location of the printing station 6 is very reliably prevented. Such a printing treatment would have the undesired consequence of a spindle being printed, as a result of which printing ink could be applied to the inner surface of an object that is subsequently placed on the spindle. Such interior printing is absolutely not permissible, certainly in the case of containers for food products.

As soon as the detection means have observed the absence of a can 2 on a spindle 5 a control signal is passed, via an apparatus which introduces a predetermined delay, to a pneumatic cylinder, 38 or 39 respectively (see FIGS. 5 and 6), as a result of which associated gear racks 40, 41 respectively undergo a displacement. Shown in FIG. 5 is a printing position of both pivoting blocks 22, 23; it will be apparent that FIG. 6 shows the block 22 in the deflected position which is a consequence of a displacement of gear rack 40 by the relevant actuation of the pneumatic cylinder 38.

For the said control, the gear racks 40, 41 co-operate with toothed wheels which are both designated for the sake of convenience with 42 and which co-operate with a slot 49 in circular arc form such that as a result of displacement of these toothed wheels 42 a pivoting movement can take place around the respective pivot shafts 43 of the blocks 22, 23. As a result of the fact that the ends of the slots 49 are located on either side of the radial direction, that is, the direction of the process forces, the printing position and the deflection position are both mechanically stable. During printing the pressure force 14 therefore contributes to maintaining the stable printing position of the pivoting blocks 22, 23. This force is therefore also not dependent upon the force produced by the pneumatic cylinders 38, 39. These cylinders 38, 39 only need to ensure a very small pivoting movement of the blocks 22, 23 under conditions where only the pivotal friction forces and possible (small) inertia resistance have to be overcome. As a result the switch between the active and inactive position can take place using little energy, and rapidly.

Particular reference is now made to FIG. 3. The carriage 8 shown comprises a first portion 143 which bears the first and second guide members, 7 and 10, 11 respectively, a second portion 44 extending from the end situated radially to the outside and transversely to it along the periphery of the carrying wheel 4, and a third portion extending from the free end of the second portion parallel to the first portion and bearing a spindle 5. The spindle is carried by a fixed shaft 45 via a ball bearing 46 arranged on its free end and a needle bearing 47 arranged on its other end.

FIG. 3 shows how the compression force 14 applied to a can 2 during printing thereof can be absorbed by the guide members 7, 10.

Indicated schematically is a line 48 extending through the fixed shaft 45 to the free end thereof, which line can be connected at choice by means (not drawn) to a source (not drawn) of overpressure or a source for underpressure. During arranging of a can 2 onto spindle 5 the former is sucked firmly onto the spindle by connecting the line 48 with the source of underpressure. For removal of the can, line 48 may, after discontinuing the connection to the source of underpressure, be connected to the overpressure source so that the can is blown off the spindle.

Figure 2:
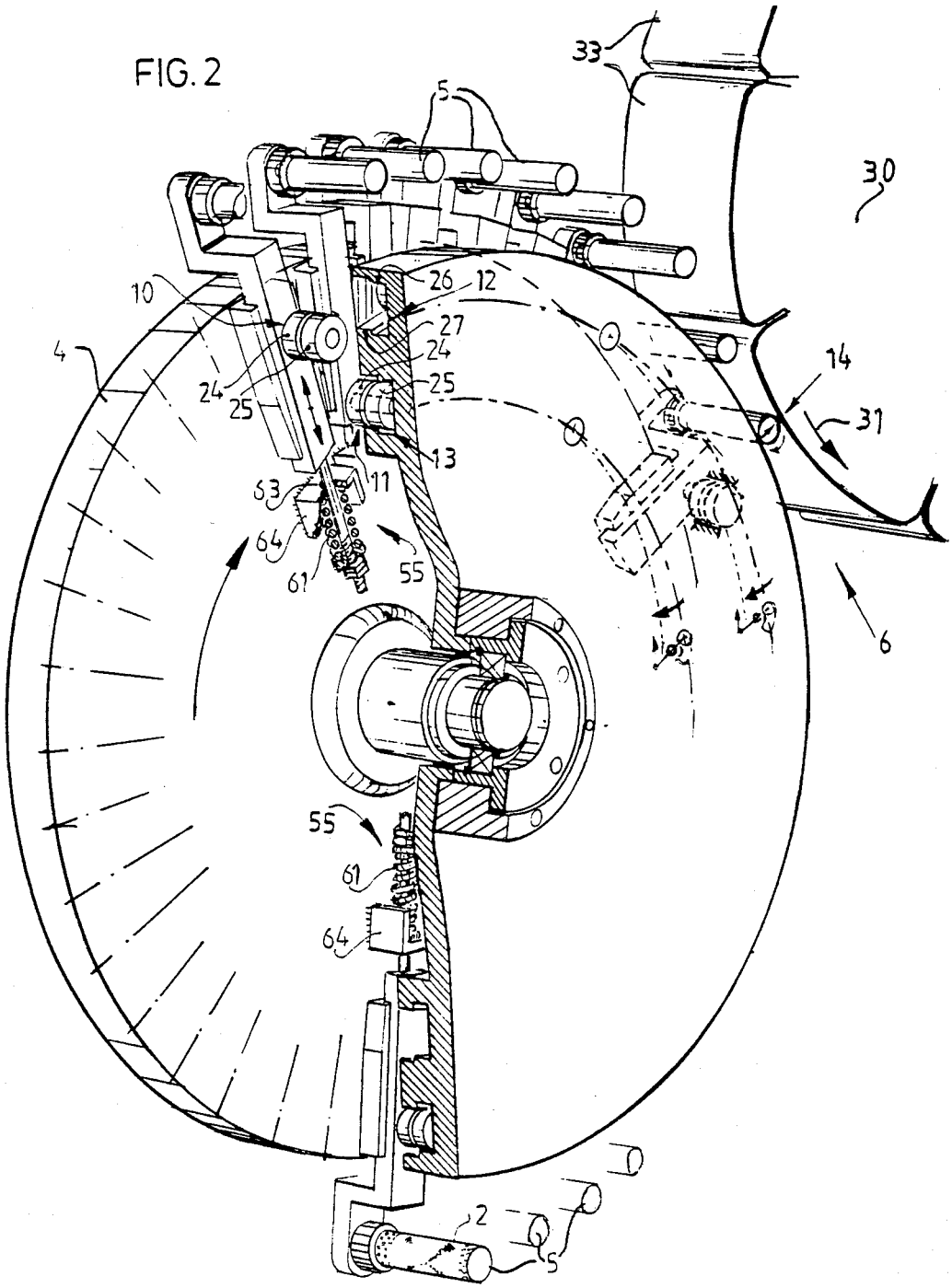
FIG. 2 shows a partly broken away perspective view of a carrying wheel with spindles.
Figure 3:
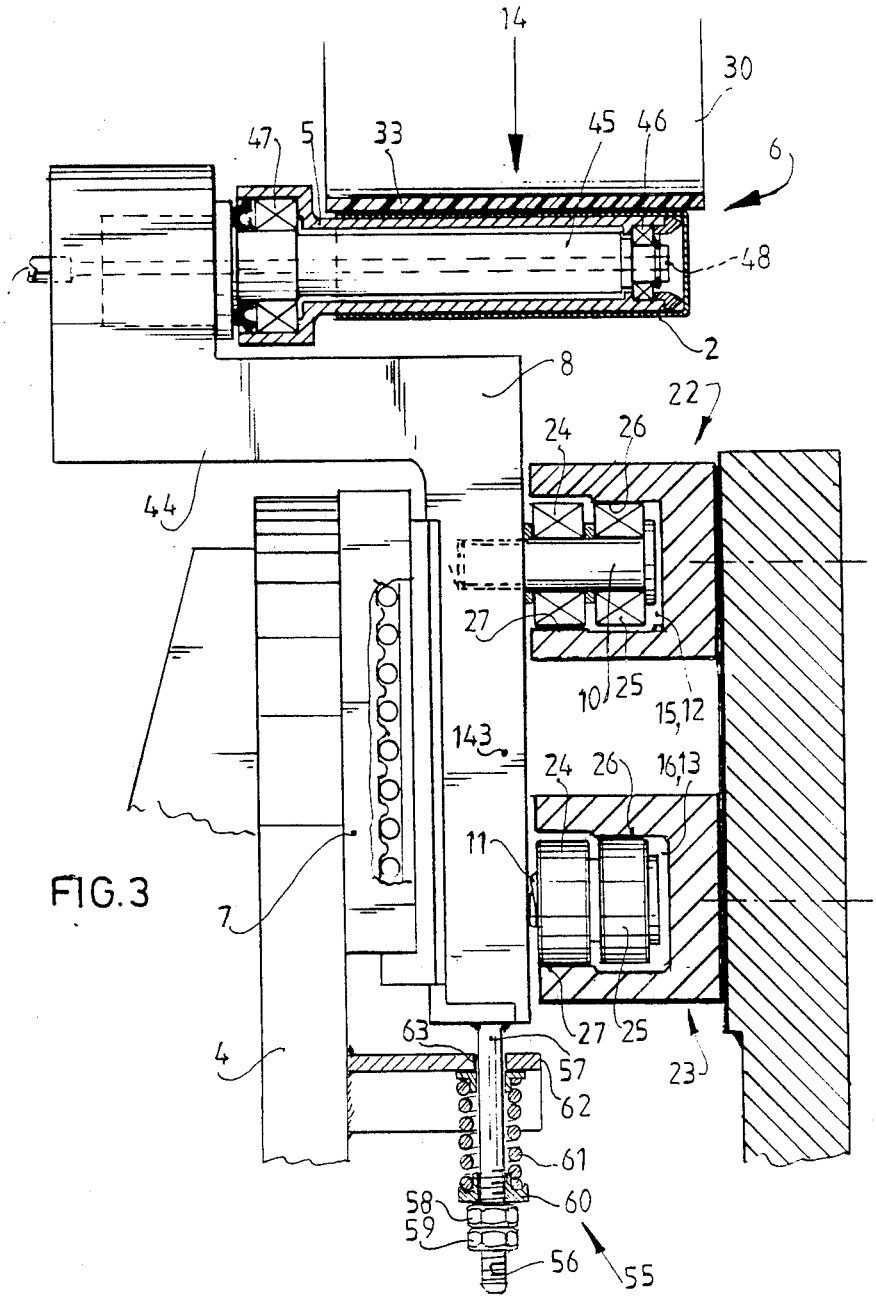
FIG. 3 is a cross section of a carriage.
Figure 4:
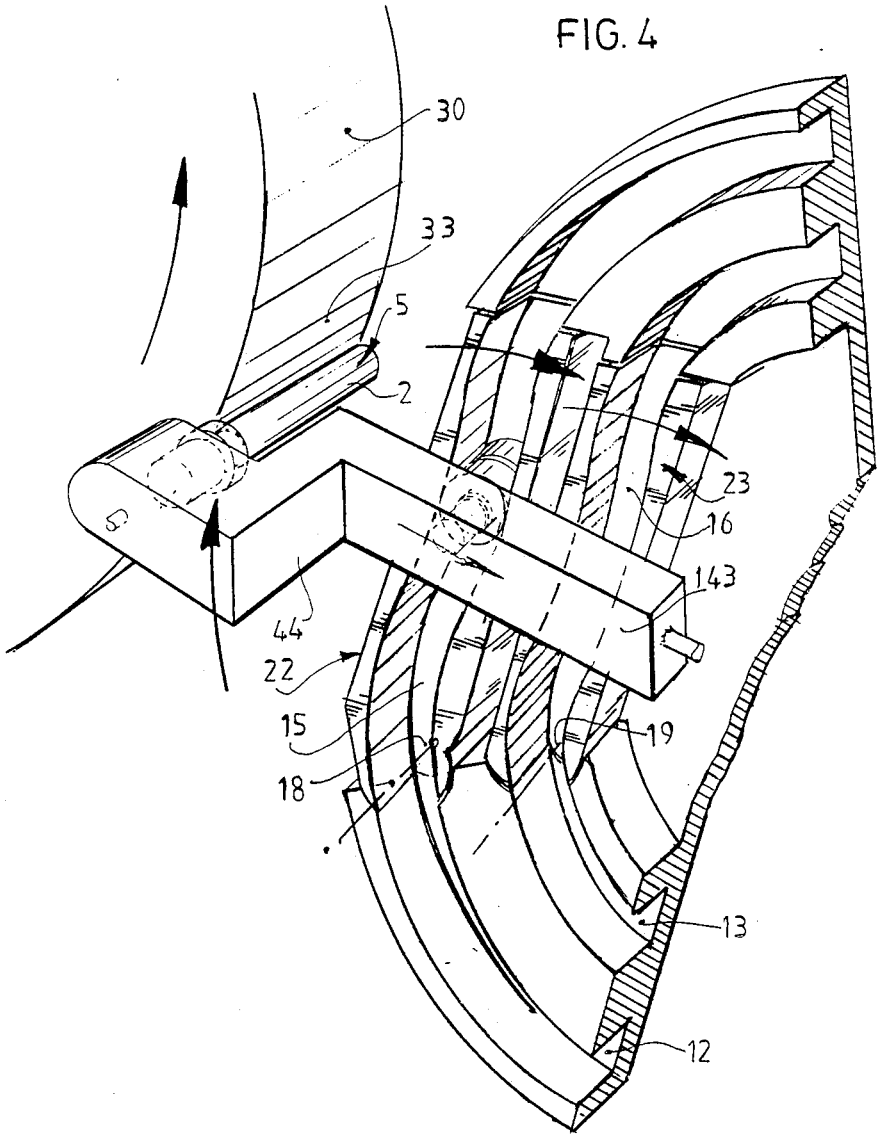
FIG. 4 shows a partly broken away perspective view of a detail.

The FIGS. 2 and 3 in particular show clearly that the carriages 8, 9 are each coupled with carrying wheel 4 via a spring member 55. This spring member 55 is shown symbolically in FIG. 1 with a broken line. This member 55 serves to press the second guide members 10, 11 counter to the outwardly acting centrifugal force against the inner walls of the guide grooves 12, 13 and deflection-guide groove parts 15, 16. It will therefore also be apparent that the spring member must apply a force to the carriages concerned 8, 9 such that the centrifugal force is always overcome. That is, the force applied by spring member 55 must be selected or adjusted depending on the total weight of a carriage 8, 9, the spindle 5 carried thereby and the first guide member 7 and second guide member 10, 11 respectively carried thereby, the effective distance of these parts relative to the axis of rotation of carrying wheel 4 and its speed of rotation.

The end of each carriage 8, 9 directed towards the centre of carrying wheel 4 is provided with a rod 57 which has a threaded end 56 on which are arranged two nuts 58, 59 which co-operate with a flange member 60 which presses a spiral spring 61 against a bulge 62 present on carrying wheel 4, the bulge being provided with a hole 63 for passage of rod 57. As is shown clearly in FIG. 2, bulge 62 is supported by two braces 64 extending in roughly radial direction and mounted on carrying wheel 4, whereby the bulge 62 and braces 64 together form a part having a substantially U-shaped cross section.

It will be apparent, particulary with reference to fig. 3, that by turning the nuts 58 and 59 the pre-tension of the spiral spring 61 can be adjusted, as has already been stated in principle above. After setting the nut 58 in the correct position, nut 59 can be tightened for locking of the said position. It is remarked that the construction of the spring member 55 is such that use is made of a compression spring for applying an inwardly directed force to the carriages 8, 9. Partly with a view to saving space, preference is given to the latter over a draw spring, which however still falls within the framework of this invention.

Figure 8:
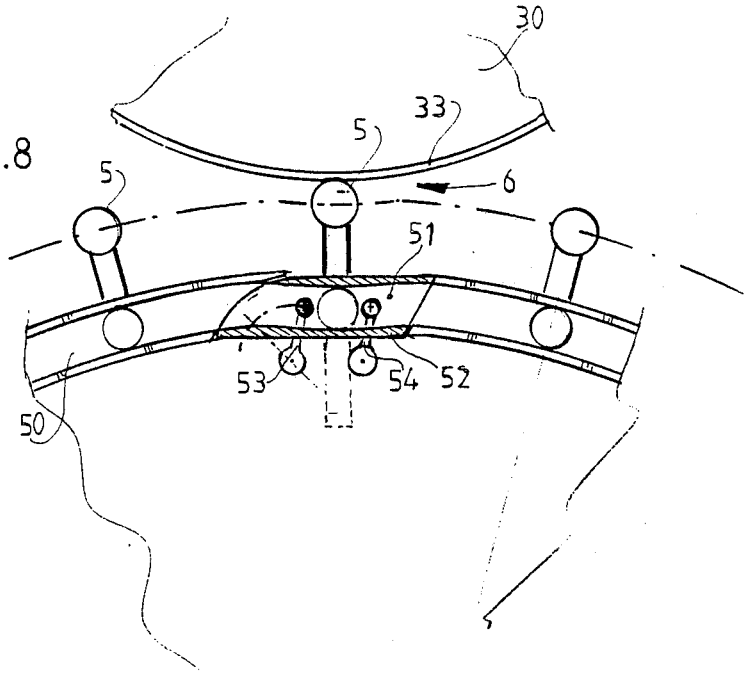
FIG. 8 shows a schematic, perspective, partly broken away front view of a detail of an alternative embodiment.

FIG. 8 shows schematically a simple variant with a guide groove 50 and a deflection-guide groove part 51 accommodated in a block 52 which can move by means of two pivoting arms 53, 54 between an active and an inactive position, this being completely analogous to that discussed above. It will be apparent from FIG. 8 that block 52 has an active position that is stable in relation to the printing force.

I claim:

1. Apparatus for successive printing of the peripheral surfaces of cylindrical objects open at one end, for example metal beakers or cans, which apparatus comprises:

a carrying wheel which can be driven for rotation at a preselected rotational speed about a first axis;

a number of spindles on the periphery of that carrying wheel and freely rotating around their longitudinal axes parallel to the axis of rotation of said carrying wheel for carrying said objects, which spindles have a form such that the objects to be printed fit onto them precisely;

a printing station placed in radial direction alongside the path of said spindles for successive printing of said objects carried by said spindles;

detection means for detecting the possible absence on a spindle of an object for printing, which detection means are connected to control means; and deflection means controlled by these control means for temporary deflection of the path of such a spindle such that it is held out of contact with said printing station, each spindle being carried by a carriage which can move in radial direction relative to the carrying wheel and which is guided by a first guide member engaged with the carrying wheel, on which carriage is also arranged a pair of second guide members which co--operate with guide grooves centered on the first axis for determining the path of said spindle carried by said carriage;

fixed guide means defining the guide grooves and disposed in spaced opposed relation to the carrying wheel whereby each carriage is sandwiched between the carrying wheel and the fixed guide means, the guide grooves receiving the second guide members of each carriage for guiding each carriage radially from a first position in which its spindle leaves a printing station to a second position in which such spindle approaches its printing station;

the first guide member of each carriage engaging the carrying wheel on one side of the carriage and the second guide members of each carriage engaging the fixed guide means on its other side so that each spindle is carried such that the pressure force applied thereto during printing of an object can substantially be absorbed without moment by the first and second guide members; and that said deflection means are formed such that a deflection-guide groove part of said guide grooves at the location of said printing station can move between two extreme positions, respectively an active printing position and an inactive deflecting position and that said printing position is one that is stable in relation to the pressure force applied.

2. Apparatus as claimed in claim 1, characterized in that the deflection-guide groove part is present in a pivoting member.

3. Apparatus as claimed in claim 2, characterized in that the foremost end of the deflection-guide groove part connects in both positions to the relevant end of the guide groove.

4. Apparatus as claimed in claim 1, characterized by rotation means positioned upstream of the printing station for bringing the objects carried by the spindles up to the rotation speed necessary for printing.

5. Apparatus as claimed in claim 4, characterized in that the rotation means are formed as a flexible belt or rope which presses against the object carried by the spindles, which extends alongside the path of said object for some tangential distance and which can be driven at a speed corresponding to the required rotation speed.

6. Apparatus as claimed in claim 1, characterized by braking means placed downstream of the printing station for decelerating the rotation of the spindles.

7. Apparatus as claimed in claim 6, characterized by an opening on the free end face of each spindle to be temporarily connected at a required moment in time with a source of overpressure for removal of an object.

8. Apparatus as claimed in claim 7, characterized by one opening which can be connected at choice to the source of overpressure or the source of underpressure.

9. Apparatus as claimed in claim 1 characterized by an opening on the free end face of each spindle to be temporarily connected at a required moment in time with a source of underpressure for suction holding of an object.

10. Apparatus as claimed in claim 1, characterized in that on its free end each carriage bears a fixed shaft, which fixed shaft bears a spindle via a ball bearing arranged on its free end and a needle bearing arranged on its other end.

11. Apparatus as claimed in claim 1, characterized in that each second guide member comprises two rollers, one for co-operation with the inward lying guide groove wall, and one for co-operation with the outward lying guide groove wall.

12. Apparatus as claimed in claim 1, characterized in that each carriage comprises:

a first portion which bears the first and second guide members;

a second portion extending transversely thereof from the end lying radially outward and along the periphery of the wheel; and a third portion bearing a spindle extending parallel to the first portion from the free end of the second portion.

13. Apparatus as claimed in claim 1, characterized by spring means for pressing the second guide member counter to the centrifugal force against the inner wall of the guide groove.

14. Apparatus for successive printing of the peripheral surfaces of cylindrical objects open at one end, for example metal beakers or cans, which apparatus comprises:

a carrying wheel which can be driven for rotation at a preselected rotational speed;

a number of spindles on the periphery of that carrying wheel and freely rotating around their longitudinal axes parallel to the axis of rotation of said carrying wheel for carrying said objects, which spindles have a form such that the objects to be printed fit onto them precisely;

a printing station placed in radial direction alongside the path of said spindles for successive printing of said objects carried by said spindles;

detection means for detecting the possible absence on a spindle of an object for printing, which detection means are connected to control means; and deflection means controlled by these control means for temporary deflection of the path of such a spindle such that it is held out of contact with said printing station, characterized in that each spindle is carried by a carriage which can move in radial direction relative to the carrying wheel and which is guided by a first guide member, on which carriage is also arranged a second guide member which co-operates with a guide groove for determining the path of said spindle carried by said carriage;

that each spindle is carried such that the pressure force applied thereto during printing of an object can substantially be absorbed without moment by both guide members; and that said deflection means are formed such that a deflection-guide groove part at the location of said printing station can move between two extreme positions, respectively an active printing position and an inactive deflecting position and that said printing position is one that is stable in relation to the pressure force applied; and including two guide grooves located at a radial distance from each other for guiding the two guide members of successive carriages.

15. Apparatus for printing on the outer surfaces of thin-walled cylindrical objects which are open at one end, which comprises the combination of carrying means for rotation about a first axis, printing means for rotation in unison with the carrying means about a second axis parallel to and spaced from the first axis to define successive peripheral print-transferring means having curvatures centered on the second axis, a plurality of carriages projecting radially outwardly of the first axis and radially slidably carried by the carrying means, a rotatable spindle carried by each carriage rotatably about a spindle axis parallel to the first axis and each adapted to receive a cylindrical object thereon, the spindles being located radially beyond the carrying means to sweep a path passing between the carrying means and the printing means as the carrying means rotates, the printing means being located in radially off-set relation relative to the carrying means on the opposite side of the path from the carrying means so that the print-transferring means are adapted to engage objects on the spindles one at a time and sequentially as the carrying means and the printing means rotate in unison, fixed guide means for defining a circular guide path centered on the first axis for guiding each carriage means from a first position in which its spindle leaves a printing station to a second position in which such spindle approaches its printing station, movable guide means centered on the second axis and bridging between the first and second positions of the fixed guide means, drive means for rotating the carrying means and the printing means at an angular velocity sufficient to impose centrifugal forces upon the carriages, means for resiliently urging each carriage radially inwardly in opposition to the centrifugal forces and against the movable guide means as the carrying means are guided therover, means for locking the movable guide means in over center relation to prevent inward radial movement of the movable guide means imposed thereon by each carriage as it is guided thereover, detector means for detecting the absence of an object on a spindle, actuator means actuated by the detector means for urging the locking means out of over center relation as the spindle from which an object is missing attains its second position whereby the movable guide means is urged radially inwardly relative to the first axis by the resilient means to displace the spindle radially inwardly away from the printing station by an amount sufficient to avoid contact between the print-transferring means and the spindle from which an object is missing.

16. Apparatus as defined in claim 15, wherein the fixed guide means and the movable guide means are disposed in facing opposition to the carrying means, each carriage having a stem portion extending radially of the carrying means, the stem portion being provided with a first guide member bearing against the carrying means and further guide members extending from the opposite side of the stem portion and received in the guide means, the line of extension of each stem portion intersecting its associated spindle substantially centrally thereof.

17. Apparatus as defined in claim 16 wherein each fixed guide means includes relatively stepped annuluses presenting inner and outer cam surfaces and each further guide member includes a pair of rollers respectively engaging the inner and outer cam surfaces.

18. Apparatus as defined in claim 17 wherein the movable guide means is in the form of short lengths of channel receiving the further guide members.

19. Apparatus as defined in claim 18 wherein the means for locking is in the form of a pair of generally radially projecting levers movable from one side to the other of a radial line.

* * * * *